United States Patent [19]

Heneveld

[11] Patent Number: 4,979,257

[45] Date of Patent: Dec. 25, 1990

[54] LINT ROLLER WITH ENCASEMENT

[76] Inventor: William R. Heneveld, 9946 Elmada, Dallas, Tex. 75220

[21] Appl. No.: 341,412

[22] Filed: Apr. 21, 1989

[51] Int. Cl.[5] ..... A47L 25/00; B25G 3/38

[52] U.S. Cl. ..... 15/104 A; 15/143 R; 15/185

[58] Field of Search ..... 15/230.11, 427, 428, 15/146, 171, 184, 185, 244.3, 247, 248 A, 258, 104 A, 143 R

[56] References Cited

U.S. PATENT DOCUMENTS

| | | | |
|---|---|---|---|
| D. 162,156 | 2/1951 | Green . | |
| D. 198,437 | 6/1964 | Wilbrecht . | |
| D. 281,654 | 12/1985 | Bladh et al. . | |
| 1,296,186 | 3/1919 | Hines | 15/185 |
| 2,423,962 | 7/1947 | Clark et al. . | |
| 2,542,774 | 2/1951 | Hutchinson . | |
| 2,658,217 | 11/1953 | Green . | |
| 3,192,548 | 7/1965 | Wilbrecht . | |
| 3,381,325 | 5/1968 | Reineman . | |
| 4,346,496 | 8/1982 | Murray | 15/185 |
| 4,422,201 | 12/1983 | McKay | 15/104 A |

*Primary Examiner*—Timothy F. Simone
*Assistant Examiner*—Scott J. Haugland
*Attorney, Agent, or Firm*—Price, Heneveld, Cooper, DeWitt & Litton

[57] ABSTRACT

A combination of a lint roller and encasement therefor in which two clam shell elements are pivotally connected together at one of their ends. One of the elements is a holder for a lint roller and the other is a cover/handle which when pivoted closed encloses the lint roller and when pivoted open serves as a handle. The two elements are each one-piece molded parts. The holder element includes a flexible flange extending from the end walls and between which the adhesive roller is rotatably mounted. The flanges preferably are circular in shape with protrusions extending therefrom having a diameter slightly less than the openings in the end of the cylindrical lint roller. The adjacent end walls of the two elements are inclined at each other so that the cover/handle when fully open extends at an angle from the axis of the roller providing space between the handle and applied surface when the roller is used on a flat surface.

12 Claims, 2 Drawing Sheets

FIG. 1
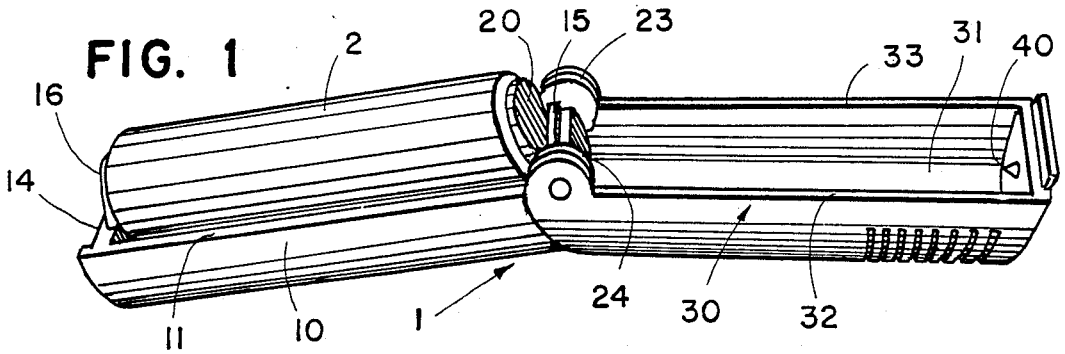
FIG. 2
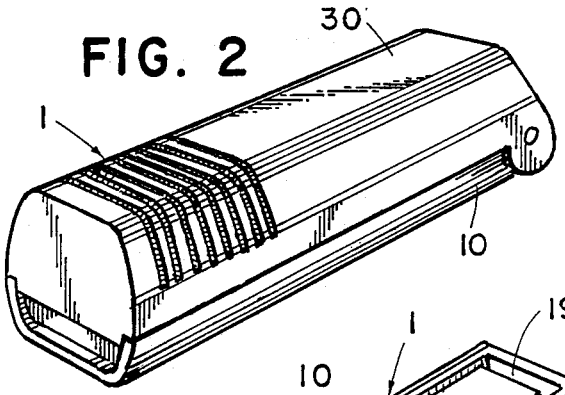
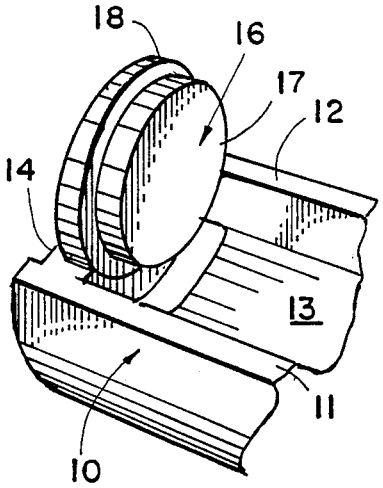
FIG. 3
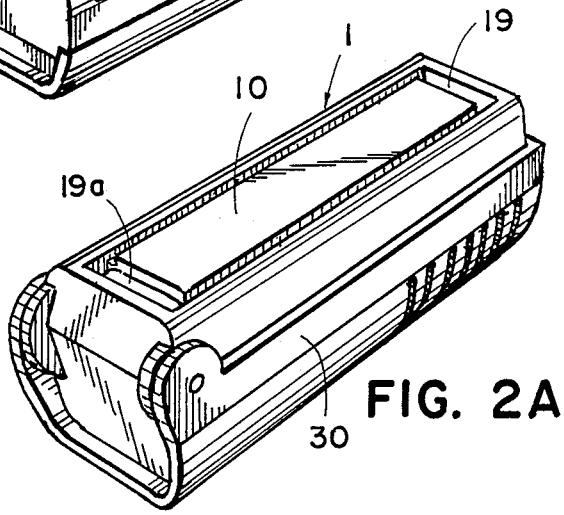
FIG. 2A
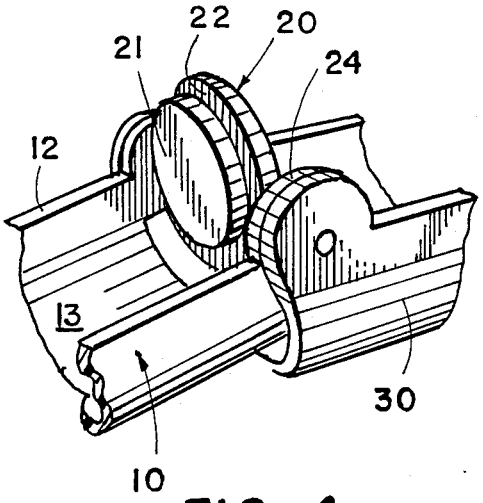
FIG. 4
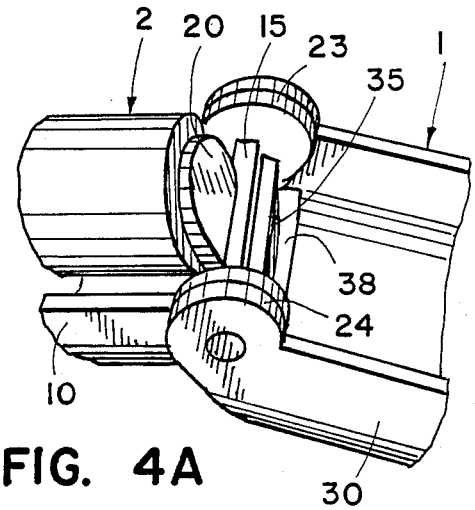
FIG. 4A

LINT ROLLER WITH ENCASEMENTv

BACKGROUND OF THE INVENTION

This invention relates to a lint roller of the type that has a tacky outer surface provided for the purpose of picking up lint, hair, dandruff, etc. from different types of surfaces such as clothing, furniture, and the like. More particularly this invention relates to such a lint roller in combination with an encasement for enclosing the roller and also for providing a handle which can be gripped by the user for the purpose of operating the roller.

Lint rollers are extremely old and attempts have been made to provide some type of encasement so as to cover the tacky surface and at the same time provide a handle for operating the roller. For example, reference is made to U.S. Patent 3,381,325 which discloses such a device but to my knowledge has not been commercially successful. It is believed that such roller construction is too costly to manufacture because of the number of parts encompassed in mounting the roller within the encasement. These parts include disc-like end walls which fit into the ends of the roller and form a part of the roller. Besides being expensive, these disc walls have flanges extending beyond the periphery of the disc roller which has the disadvantage, of preventing the tacky surface from contacting the surface being treated, particularly when the roller is to be rolled on a relatively flat surface. Further, the number of parts make it cumbersome to change the roller and also adds to the cost of the entire item which is an important factor in low cost items of this type.

Further, to my knowledge, all lint collectors of this type which include a handle forming part of the encasement are cumbersome to use on flat surfaces because in grabbing the handle the fingers of the user prohibit the entire roller from contacting the surface.

SUMMARY OF THE INVENTION

In accordance with this invention, I have provided a combination lint roller with encasement which if formed of the minimum number of parts, i.e., the roller holder, the handle, and the roller itself. The roller holder and the handle are both one-piece parts molded out of high impact plastic material such as Styrene and ABS. The parts can easily be assembled after molded and the roller can be easily installed on the holder. The two parts are arranged to completely encompass or encase the roller when not in use. Thus, the lint roller can be carried in a lady's purse or handbag, in a person's pocket, in a suitcase or other type of containers or conveniently stored without exposing the tacky surface of the roller.

Also in accordance with this invention, the roller holder and the handle can be opened form closed position to provide a handle that can be easily gripped. The handle is oriented with respect to the roller so as to minimize the interference generally created by the fingers of the user, particularly when the roller is to be applied to a relatively flat surface.

The present invention provides a unique construction for holding the roller within the holder, such construction being a pair of circular flanges extending from the end walls of the holder and including protrusions that fit into the openings in the end of the roller to hold the roller in place but also permitting it to be rotated. These circular flanges are of a dimension which minimizes the frictional forces on the ends of the roller so that the roller can easily rotate on the protrusions.

The invention also provides a unique construction for retaining the holder in the handle in the position previously referred to by providing a unique camming mechanism that releasably retains the holder and handle in such position but permits the two parts to be pivoted closed. This invention also provides a means for releasably retaining the handle and the holder in a closed position in which position the tacky surface of the roller is protected.

BRIEF DESCRIPTION OF THE DRAWINGS

This invention will be described in conjunction with the drawings wherein:

FIG. 1 is a perspective view of the combination lint roller and encasement in open position;

FIG. 2 is a top, perspective view of the invention in closed position;

FIG. 2A is a bottom, perspective view of the invention in closed position;

FIG. 3 is a partial, elevational, perspective view of one end of the roller holder;

FIG. 4 is a partial, elevational perspective view of the other end of the roller holder pivotally connected to the cover or handle;

Figure 5:
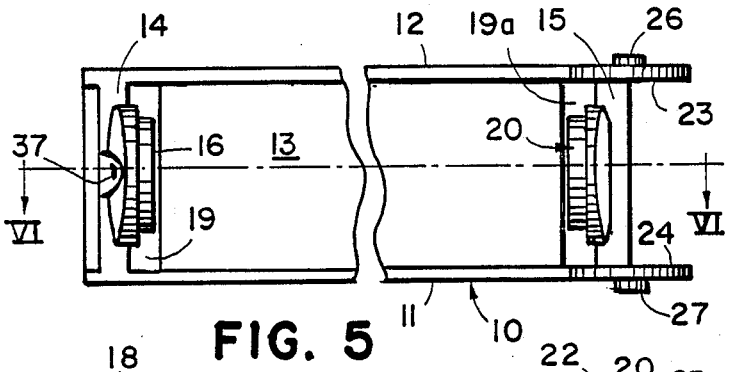
Figure 7:
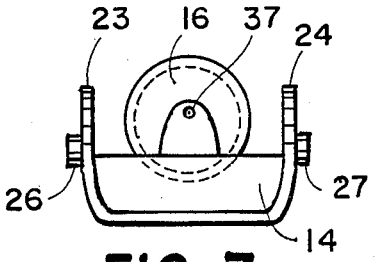
Figure 6:
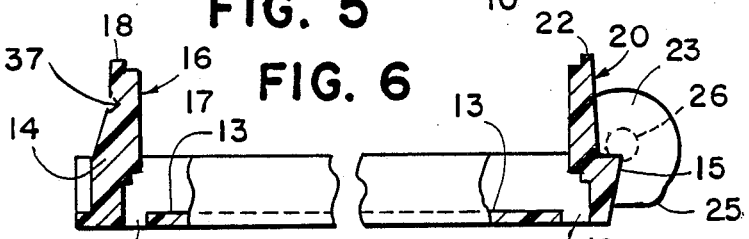
Figure 8:
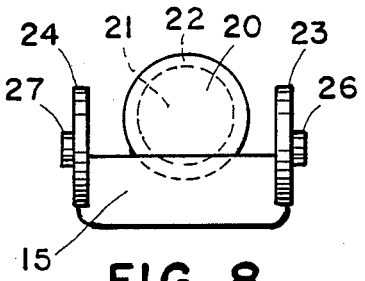
Figure 13:
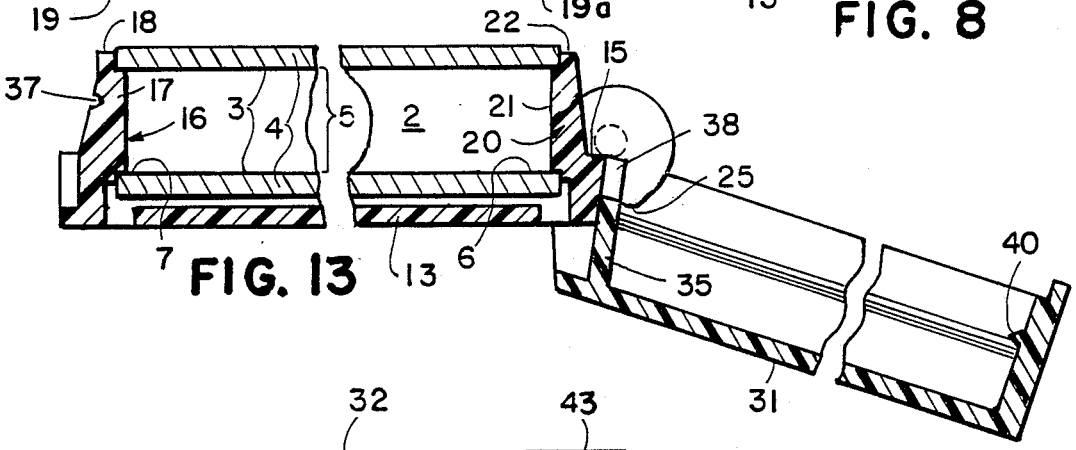
Figure 9:
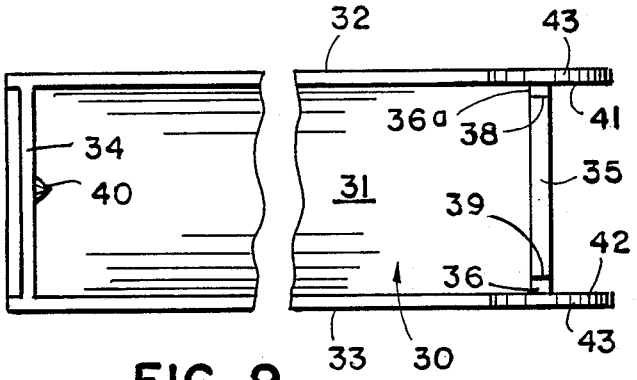
Figure 11:
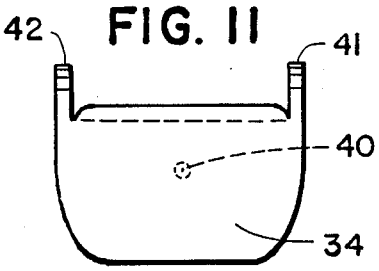
Figure 10:
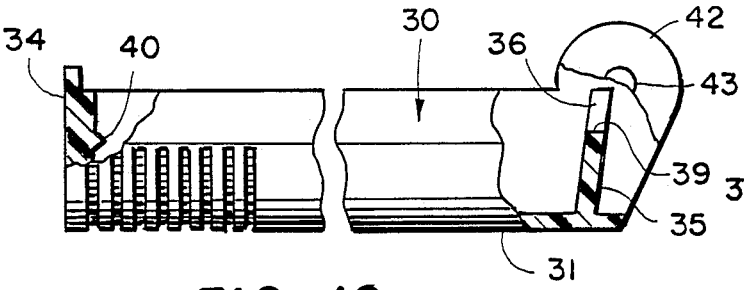
Figure 12:
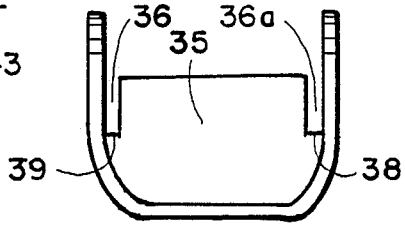

FIG. **4*a*** is another partial, elevational perspective view of the roller holder pivotally connected to the cover but taken from a different perspective;

FIG. 5 is a top, plan view of the lint roller holder;

FIG. 6 is a cross-sectional view taken along the plane VI—VI of FIG. 5;

FIG. 7 is an end, elevational view of the holder of FIGS. 5 and 6;

FIG. 8 is an elevational view of the other end of the holder of FIGS. 5, 6 and 7;

FIG. 9 is a top, plan view of the cover or handle;

FIG. 10 is a side, elevational view of the cover or handle partially cut away to illustrate certain details of the construction;

FIG. 11 is an end, elevational view of one of the ends of the cover or handle of FIGS. 9 and 10;

FIG. 12 is an end, elevational view of the other end of the cover or handle of FIGS. 9, 10 and 11; and FIG. 13 is a side elevational, cross-sectional view of the two parts of the invention pivotally connected in open position and the lint roller in place.

DETAILED DESCRIPTION OF THE PREFERRED EMBODIMENT

Referring to FIG. 1, reference numeral 1 designates the lint roller with encasement which includes three parts, the roller holder 10, the cover or handle 30 (herein referred to sometimes as cover/handle or handle/cover) and the adhesive roller 2. The holder 10 and cover/handle are both molded in one piece out of a high impact plastic material such as Styrene and ABS. The lint roller 2 as disclosed in FIG. 13 comprises a cylindrical support member 3 constructed of a cardboard like material formed of a plurality of layers of paper over which is wrapped a layer 4 of tacky material. The roller has a centrally located bore 5 extending through the entire cylinder so as to provide openings 6 and 7 at the ends of the roller.

Referring to FIGS. 5, 6, 7 and 8, the holder 10 is a one-piece molded part having the side walls 11 and 12 extending upwardly from the base 13. At the end of the holder 10 are the end walls 14 and 15. Extending upwardly and slightly inwardly from the wall 14 is the disc-shaped flange 16 which preferably is circular in shape (FIGS. 3 and 7). The flange 16 is sufficiently flexible to accommodate the roller 2 (FIG. 13) as will be described hereinafter. Flange 16 is formed of two circular portions 17 and 18. The part 18 is of a diameter slightly less than the diameter of the adhesive roller 2 but greater than the diameters of the openings 6 and 7, all as illustrated in FIG. 13. An opening 19 (FIGS. 5 and 6) provided to mold the bottom half of disc-shaped flange 16.

At the other end of the holder 10, another flange 20 extends upwardly from the wall portion 15. It also has two portions 21 and 22 of substantially identical shape and dimension as the portions 17 and 18 of the flange 16. An opening **19*a* is provided along wall portion 15 for the same purpose as opening 19**.

Holder 10 has a pair of ears 23 and 24 of substantially circular shape. Both of these ears are slightly out of round at their lower portions as disclosed in FIG. 13 at 25. The purpose of the out-of-round shape is to provide a means for holding the two parts 10 and 30 in open position as disclosed in FIGS. 1 and 13.

It will be noted that the wall portion 15 is inclined slightly to the right as viewed in FIG. 6, this slight angle of inclination being provided for orienting the handle 30 in an inclined position relative to the holder and lint roller as will be described hereinafter.

Trunnions or pins 26 and 27 extend outwardly from the ears 23 and 24 for the purpose of pivoting of holder 10 and handle/cover 30 together.

The cover or handle 30 (FIGS. 9 and 10) is a one-piece molded part comprising the base 31, the two side walls 32 and 33 and the end walls 34 and 35. Cover 30 is deeper in dimension than holder 10 for the purpose of receiving the roller and the flanges 16 and 20 which extend beyond the depth of the side walls 11 and 12. Cover/handle 30 has two ears 41 and 42 corresponding to but not identical to the shape of ears 23 and 24. Each ear 41, 42 has an opening 43 for receiving the trunnions or pins 26 and 27. All the ears have a very slight degree of flexibility and resilience so that ears 23 and 24 can be slipped between ears 41 and 42 until the pins 26 and 27 are aligned with openings 43 in which event the pins snap into the openings 43.

Slots 36 and **36*a* (reference FIG. 12) are formed in the end wall 35 for receiving the ears 23 and 24 so that the ears can overlap each other as disclosed in FIGS. 1, 4, 4*a* and 13. These slots form cammed surfaces 38 and 39, the cammed surface 38 being most evident in FIG. 12 and FIG. 13. It is these cammed surfaces over which out-of-round portions 25 of the ears 23 and 24 ride to hold the holder 10 and cover/handle 30** in open position.

It will be noted that the end wall 35 is inclined specifically for the purpose of providing a means for orienting the handle 30 at an angle relative to the axis of the roller when mounted on the flanges 16 and 20. The purpose for this orientation is to locate the handle at an angle above any flat surface on which the roller is being applied. In the alternative, this angle can be accomplished by increasing the angle of surface 15 of holder 10.

OPERATION

Having described the details of the three parts of this invention, the operation should become quite evident. The roller 2 is first placed into position between the two flanges 16 and 20. In this position, as disclosed in FIG. 13, the portion 18 of the flange 16 engages the ends of the roller 2 with the protrusions 17 and 21 extending into the openings 7 and 6, respectively. Once the roller is in place, it can freely turn about the protrusions 17 and 21 because of the relatively low friction on the surfaces of the flange portions 18 and 22. The handle or cover 30 is pivoted all the way open until end wall 35 engages the end wall 15 (FIG. 13). In this position, the out-of-round portions 25 of the ears 23 and 24 have passed over the cammed portions 38 and 39 which releasably retains the handle 30 in a position as disclosed in FIGS. 1, 4, **4*a*, and 13. In this position, there is sufficient amount of room for the fingers of the user to grab and hold the handle 30** while the roller is rolled over a flat surface.

When the sue of the lint roller 2 is completed, the handle/cover 30 is pivoted over the holder 10 resulting in the edges of the side walls 32 and 33 and the end walls 34 and 35 of the cover engaging the edges of the side walls 11 and 12 and end walls 14 and 15, respectively, so as to completely cover the roller 2. In this position, the detent 40 of the cover 30 is cammed into the indentation 37 in flange 16 of the holder 10. This retains the cover on the holder while at the same time making it possible to easily release the cover for using the roller as above described.

Having described my invention, it should be evident that I have provided a greatly improved lint roller with an encasement. The entire unit is formed of only three parts which are easily assembled while at the same time being less costly and easier to use, particularly on flat surfaces.

Although I have disclosed the preferred embodiment of this invention, it should be evident that there are other embodiments that could be made without departing from the spirit of this invention. Accordingly, the scope of my invention should be limited only as set forth in the appended claims.

The embodiments of the invention in which an exclusive property or privilege is claimed are defined as follows:

1. A combination of lint roller and an encasement therefor comprising: a first elongated clam shell roller supporting element and a second elongated clam shell cover element pivotally connected together at one of each of their ends to form an enclosure for an adhesive roller; each of said clam shell elements being an integrally molded plastic part;

an adhesive roller formed into the shape of a tube and including a cylindrical support member having a continuous cylindrical opening of substantially the same diameter extending throughout the length of said tube; said surface of said opening permitting free turning of said roller on protrusions extending into the ends of said opening, said cylindrical support member having a tacky outer surface means for picking lint, hair, dandruff, etc. off a surface upon contact therewith;

said first clam shell roller supporting element including an elongated molded first part having a first base, a first pair of spaced side walls, and a first pair of spaced end walls connected between the ends of said first side walls;

a pair of spaced resilient flanges each flange connected to one of said first end walls; each flange having a width less than the width of said first end walls and at least as wide as the diameter of the cylindrical support member of said adhesive roller and extending from said first end walls in a direction away from said first base; said flanges each having integrally molded protrusion means extending toward the other flange and having a combined shape and outer dimension slightly less than the cylindrical opening of said cylindrical support member so as to extend into the opening of one of said ends of said adhesive roller whereby the protrusions rotatably support said lint roller, said protrusion of one flange being spaced from the protrusions of the other flange a distance slightly less than the length of said adhesive roller, said flanges being sufficiently flexible to flex away from each other for receiving said adhesive roller therebetween and of sufficient memory to retract after being flexed to force and hold said protrusions in the ends of said opening;

said second clam shell cover element including a second base with second side walls integrally molded therewith and a second pair of end walls connected between the ends of said side walls; said clam shell elements being pivotally connected together at one of each of the ends thereof;

said first and second side walls and first and second end walls being shaped and dimensioned to engage each other when pivoted to closed position to thereby enclose said adhesive roller and when open said second clam shell cover element providing a handle to grasp when operating the adhesive roller.

2. The device of claim 1 in which the adjacent first and second end walls proximate said pivotal ends are arranged at an angle with respect to each other whereby when fully open the first and second bases are angular with respect to each other whereby when the roller is rolled on a flat surface the second clam shell element is oriented at an angle to said surface providing a space between said surface and the handle formed by said second clam shell element.

3. The device of claim 2 in which means is provided to releasably retain said handle formed by said second clam shell element in said oriented angle.

4. The device of claim 1 in which each of said clam shell elements have a pair of spaced ears located at the pivotal ends, the ears of one pair of each having an opening and the ears of the other pair each having a pin integrally molded therewith and received within one of said openings.

5. The device of claim 4 in which means is provided adjacent at least one of said ears for releasably retaining said clam shell elements in open position.

6. The device of claim 5 in which said means for holding said clam shell elements in open position includes cooperating cam means on one of said ears of one of said clam shell elements and a camming surface on the other of said clam shell elements.

7. The device of claim 5 in which the adjacent first and second end walls proximate said pivotal ends are arranged at an angle with respect to each other whereby when fully open the first and second bases are angular with respect to each other whereby when the roller is rolled on a flat surface the second clam shell element is oriented at an angle to said surface providing a space between said surface and the handle formed by said second clam shell element.

8. The device of claim 1 in which said protrusions are cylindrical protrusions integrally molded on the sides of said flanges facing each other.

9. The device of claim 1 in which said flanges are slightly inclined toward each other and which flex in a direction away from each other to a position for installing said roller.

10. The device of claim 1 in which elongated openings are molded in said first base along and immediately adjacent said first end walls to allow molding of said cylindrical protrusions.

11. The device of claim 1 in which said flange located opposite said pivotal end of said first clam shell element and the inside surface of said second end wall located opposite said pivotal end of said second clam shell element have a cooperating indentation and detent means for releasably holding said clam shell elements in closed position.

12. The device of claim 1 in which the flanges are circular and form a part of said first end walls, the outer diameters of said circular flanges being less than the outer diameters of said roller but greater than the diameter of said openings in the ends of said roller whereby a minimum amount of friction is created between said flanges and said ends of said roller.

* * * * *